US011118487B1

(12) United States Patent
Balabhadrapatruni

(10) Patent No.: US 11,118,487 B1
(45) Date of Patent: Sep. 14, 2021

(54) TIMING WHEEL FOR CAMSHAFT PHASER

(71) Applicant: Schaeffler Technologies AG & Co. KG, Herzogenaurach (DE)

(72) Inventor: Sowjanya Balabhadrapatruni, Rochester, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/853,217

(22) Filed: Apr. 20, 2020

(51) Int. Cl.
*F01L 1/344* (2006.01)

(52) U.S. Cl.
CPC ... *F01L 1/3442* (2013.01); *F01L 2001/34426* (2013.01); *F01L 2820/041* (2013.01)

(58) Field of Classification Search
CPC ... F01L 1/3442; F01L 2820/041; F01L 1/344; F01L 1/047; F01L 1/34; F01L 2001/34483; F01L 2303/00
USPC ..... 123/90.17, 90.15
See application file for complete search history.

(56) References Cited

U.S. PATENT DOCUMENTS 7,305,949 B2 * 12/2007 McCarthy ..... F01L 1/34 123/195 C
10,563,547 B1 2/2020 Camilo et al.
2005/0066924 A1 * 3/2005 Lehmann ..... F01L 1/3442 123/90.17
2006/0278188 A1 * 12/2006 Payne ..... F01L 1/344 123/90.17
2007/0277757 A1 * 12/2007 Fischer ..... F01L 1/022 123/90.17
2009/0211549 A1 * 8/2009 Myers ..... F01L 1/3442 123/90.17
2010/0095919 A1 * 4/2010 Myers ..... F01L 1/3442 123/90.17
2011/0120399 A1 * 5/2011 Weber ..... F01L 1/3442 123/90.15
2013/0180483 A1 * 7/2013 Weisser ..... F01L 1/3442 123/90.15
2014/0096731 A1 * 4/2014 Yasuki ..... F01L 1/3442 123/90.15
2014/0202410 A1 * 7/2014 Stolk ..... F01L 1/352 123/90.17
2020/0056515 A1 2/2020 Camilo et al.

FOREIGN PATENT DOCUMENTS

DE 102014211431 A1 * 12/2015 ..... F01L 1/3442
DE 102016221835 A1 5/2018

OTHER PUBLICATIONS

DE-102014211431 English Language Machine Translation Dec. 2015.*

* cited by examiner

*Primary Examiner* — Patrick Hamo
*Assistant Examiner* — Wesley G Harris
(74) *Attorney, Agent, or Firm* — Matthew V. Evans

(57) ABSTRACT

A camshaft phaser is provided that includes a stator, a rotor having a plurality of vanes that form fluid chambers with the stator, and a timing wheel attached to the rotor. The rotor includes an axial fastening interface with an annular groove for receiving an annular protrusion of the timing wheel.

17 Claims, 7 Drawing Sheets

TIMING WHEEL FOR CAMSHAFT PHASER

TECHNICAL FIELD

Example aspects described herein relate to camshaft phasers, and, more particularly, to camshaft phasers utilized within an internal combustion (IC) engine.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. A timing wheel is often employed within the camshaft phaser to facilitate tracking of a rotational position of the camshaft. A robust and cost effective means of attaching the timing wheel to the rotor is needed.

SUMMARY

In an example embodiment, a camshaft phaser includes a stator, a rotor having a plurality of vanes that form fluid chambers with the stator, and a timing wheel. The rotor is configured to be non-rotatably connected to a camshaft of an internal combustion engine. The timing wheel is attached in a pre-defined orientation to the rotor and is configured to cooperate with a camshaft position sensor to provide an angular position of the camshaft. The rotor has an axial fastening interface that defines an annular groove for receiving an annular protrusion of the timing wheel. The annular protrusion can be arranged on a radial flange of the timing wheel, and the annular protrusion can form a press-fit with the annular groove of the rotor. The annular groove and the annular protrusion can extend 360 degrees.

The radial flange can have a plurality of segments that are configured to engage the axial fastening interface, each segment having a length and a sum of the lengths can be greater than a width of the radial flange.

The radial flange and axial fastening surface can define at least three non-planar contact zones that reside between the axial fastening interface and the radial flange.

The axial fastening interface can include a chamfer that receives an angled portion of the radial flange.

The camshaft phaser can include a central fastener that axially clamps the timing wheel to the rotor. The central fastener can be a housing of a hydraulic fluid control valve.

The camshaft phaser can include a bias spring that is attached to both the rotor and stator, and a cover that is non-rotatably attached to the rotor. An axial space formed between the timing wheel and cover can house the bias spring.

The timing wheel can include a radial protrusion that is configured to cooperate with a recess arranged on the rotor to define the pre-defined orientation of the timing wheel. The radial protrusion can form an interference fit with the recess.

The timing wheel can also have a disk portion that includes a radial outer wall that defines sensing windows configured to cooperate with the camshaft position sensor to provide an angular position of the camshaft.

The timing wheel can house at least a portion of a hydraulic fluid control valve or a portion of the bias spring on a radially inner side and an axially outer side.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
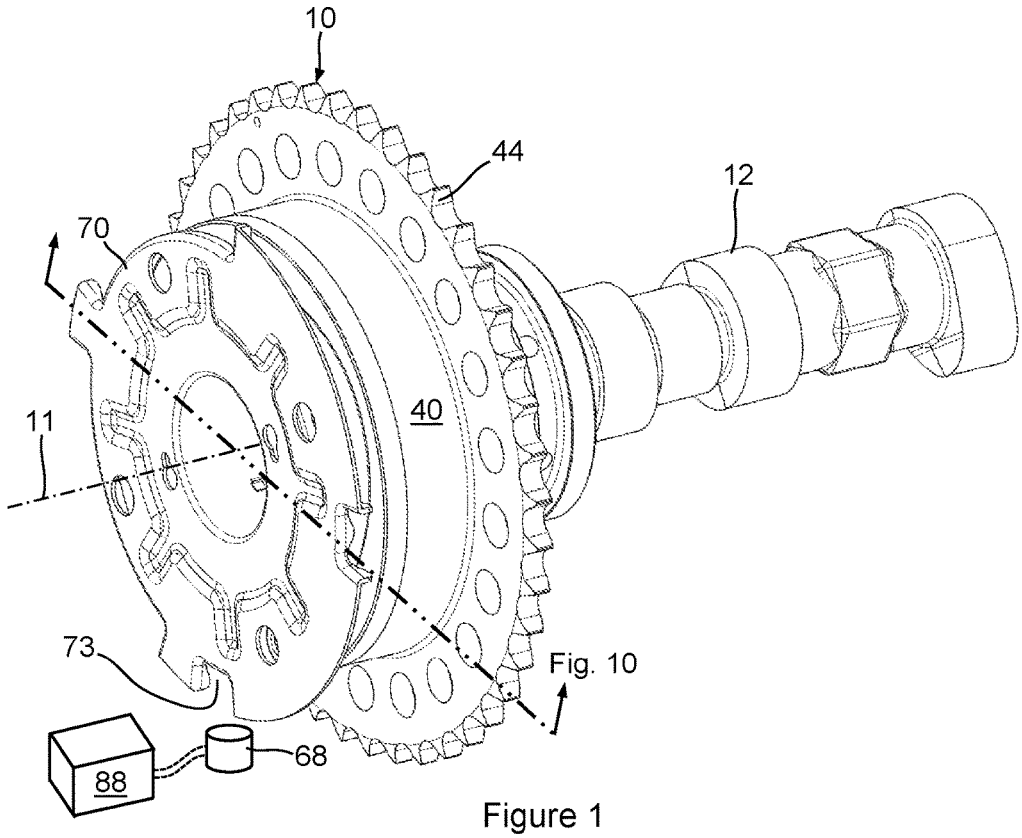
FIG. 1 is a perspective view of a camshaft together with an example embodiment of a camshaft phaser that includes a timing wheel.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

A term "non-rotatably connected" can be used to help describe various connections of camshaft phaser components and is meant to signify two elements that are directly or indirectly connected in a way that whenever one of the elements rotate, both of the elements rotate in unison, such that relative rotation between these elements is not possible.

Radial and/or axial movement of non-rotatably connected elements with respect to each other is possible, but not required.

Figure 2:
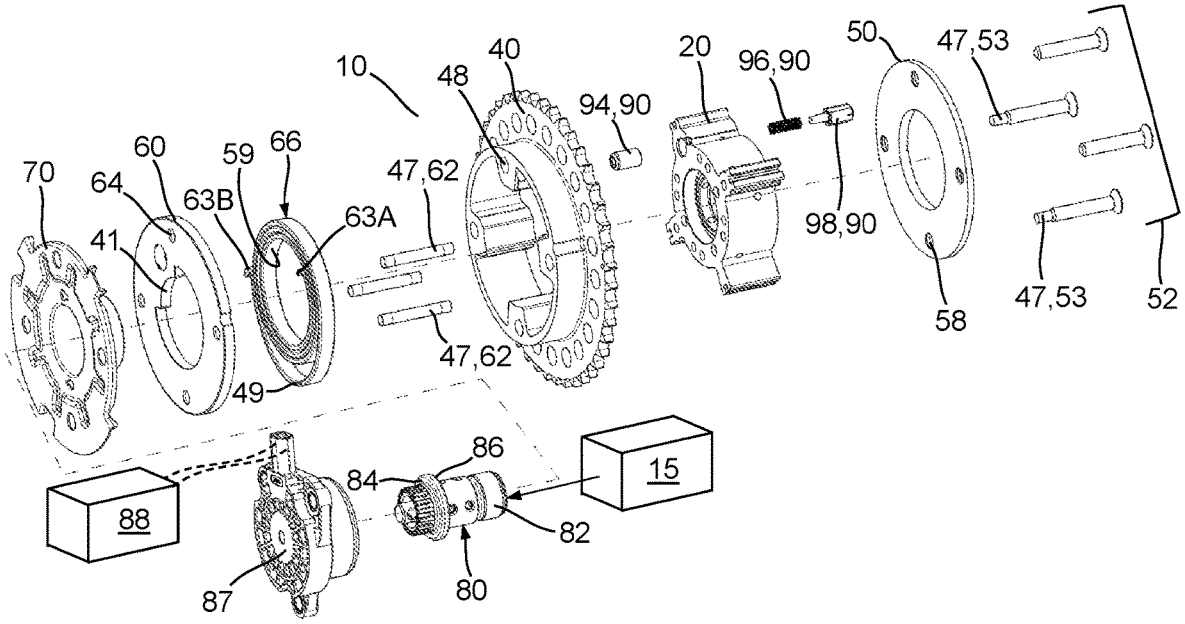
FIG. 2 is an exploded perspective view of the camshaft phaser of FIG. 1.
Figure 3:
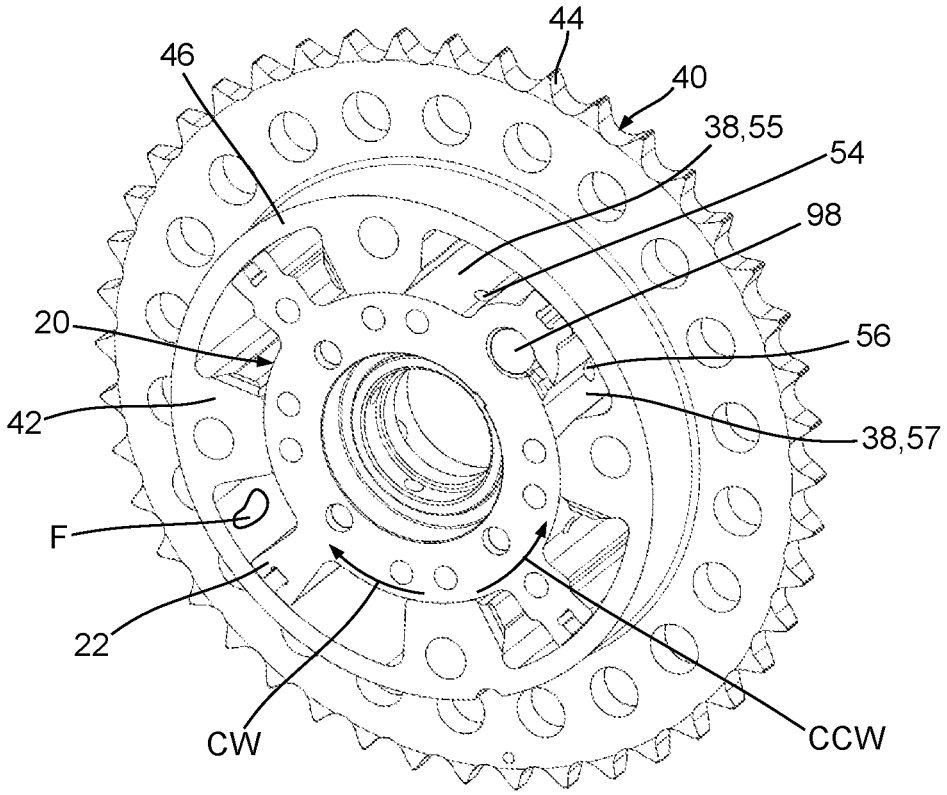
FIG. 3 is a perspective view of a rotor and stator of the camshaft phaser of FIG. 1.
Figure 4A:
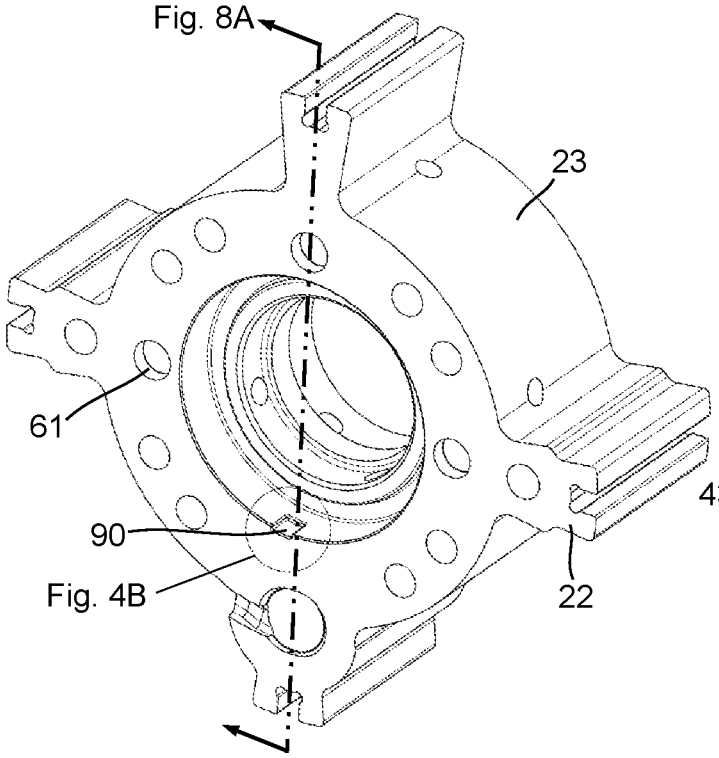
FIG. 4A is a perspective view of the rotor of the camshaft phaser of FIG. 1.
Figure 4B:
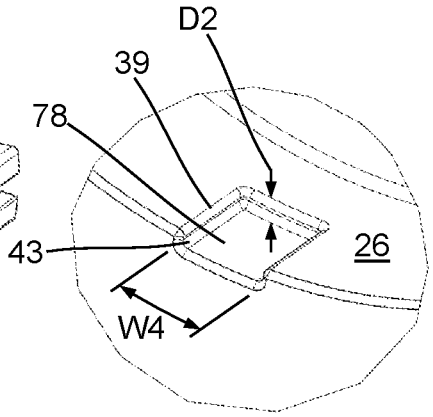
FIG. 4B is a detailed view taken from FIG. 4A.
Figure 5A:
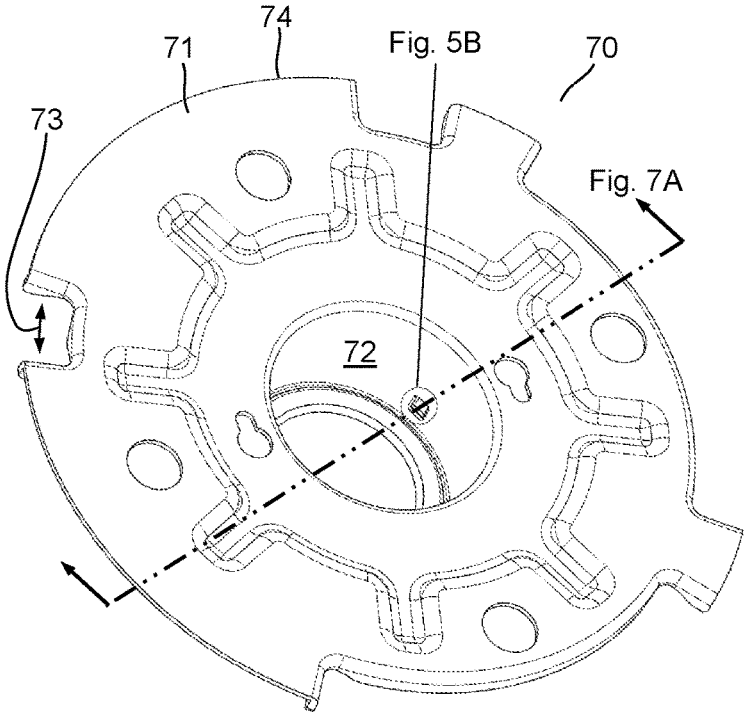
FIG. 5A is a perspective view of the timing wheel of the camshaft phaser of FIG. 1.
Figure 5B:
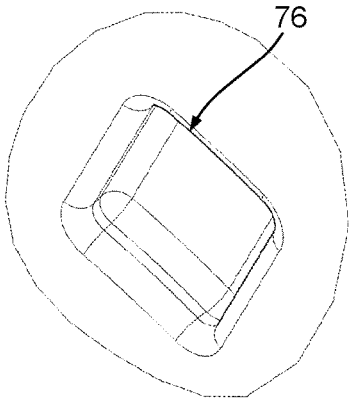
FIG. 5B is a detailed view taken from FIG. 5A.
Figure 6A:
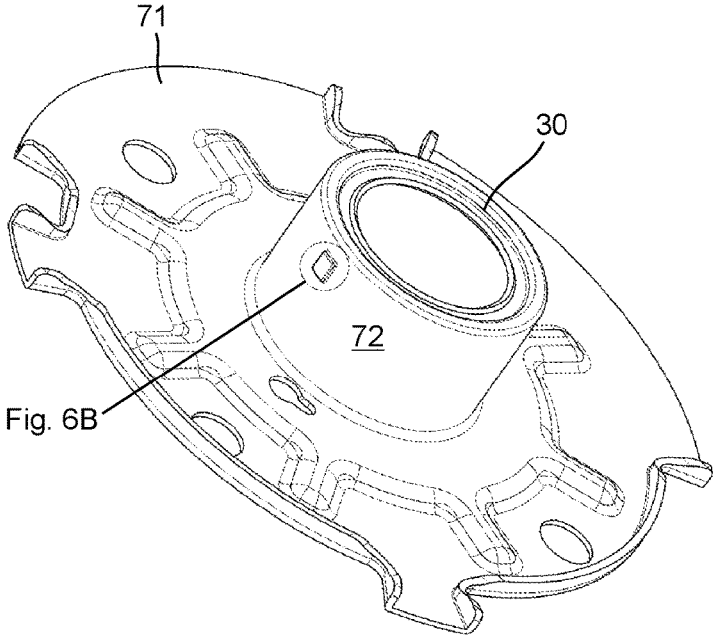
FIG. 6A is a perspective view of the timing wheel of the camshaft phaser of FIG. 1.
Figure 6B:
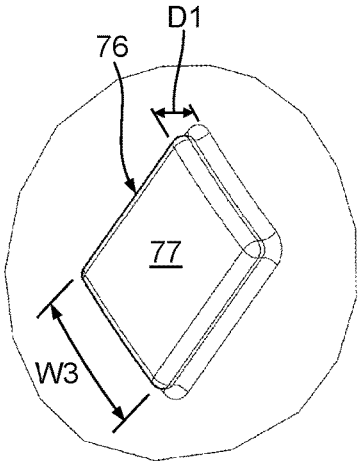
FIG. 6B is a detailed view taken from FIG. 6A.
Figure 7A:
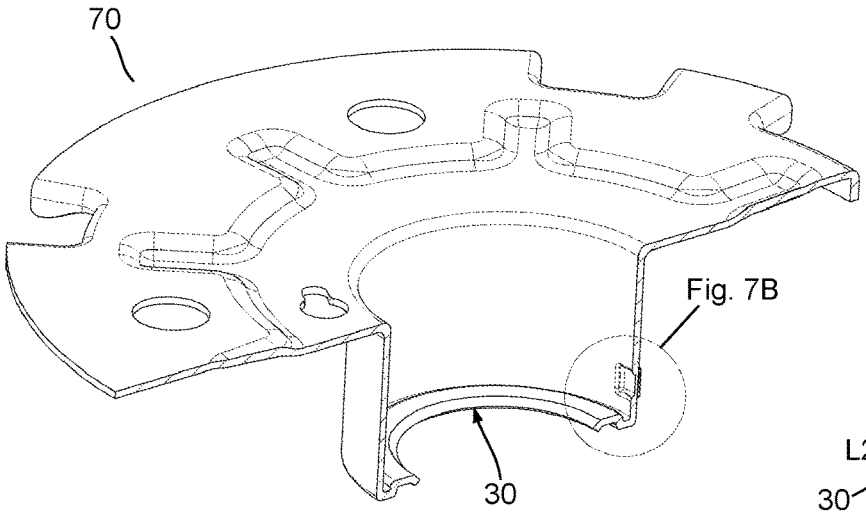
FIG. 7A is a perspective view of a cross-section taken from FIG. 5A.
Figure 7B:
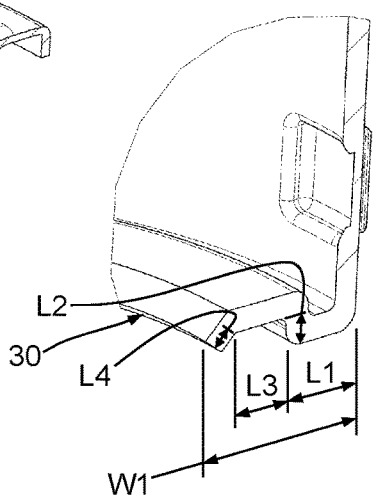
FIG. 7B is a detailed view taken from FIG. 7A.
Figure 7C:
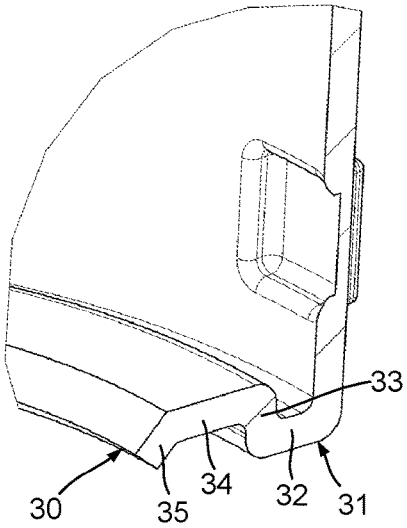
FIG. 7C is a detailed view taken from FIG. 7A.
Figure 7D:
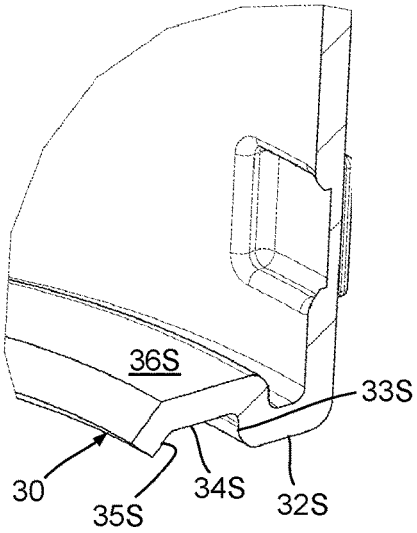
FIG. 7D is a detailed view taken from FIG. 7A.
Figure 8A:
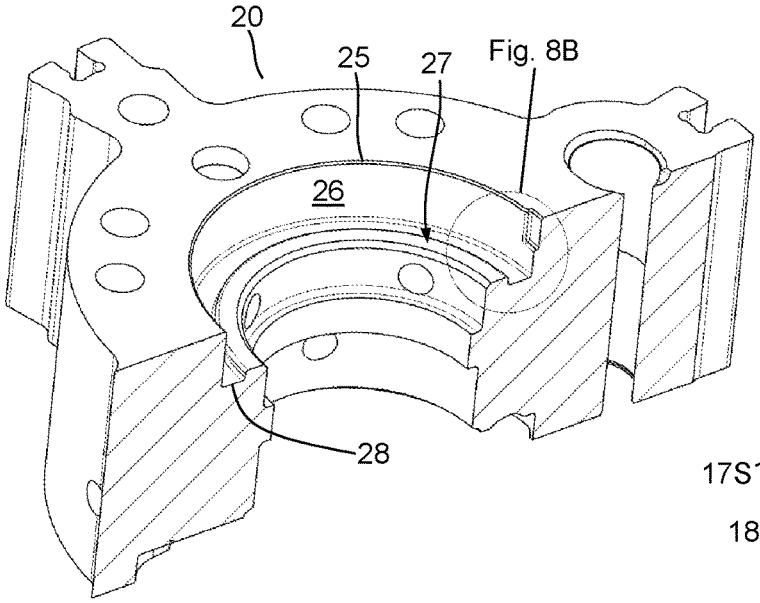
FIG. 8A is a perspective view of a cross-section taken from FIG. 4A.
Figure 8B:
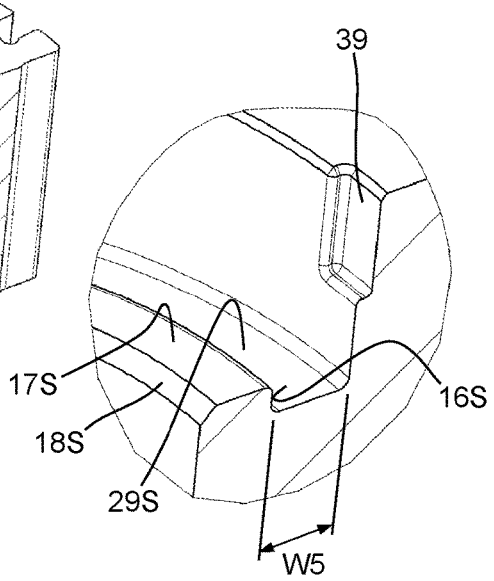
FIG. 8B is a detailed view taken from FIG. 8A.
Figure 9:
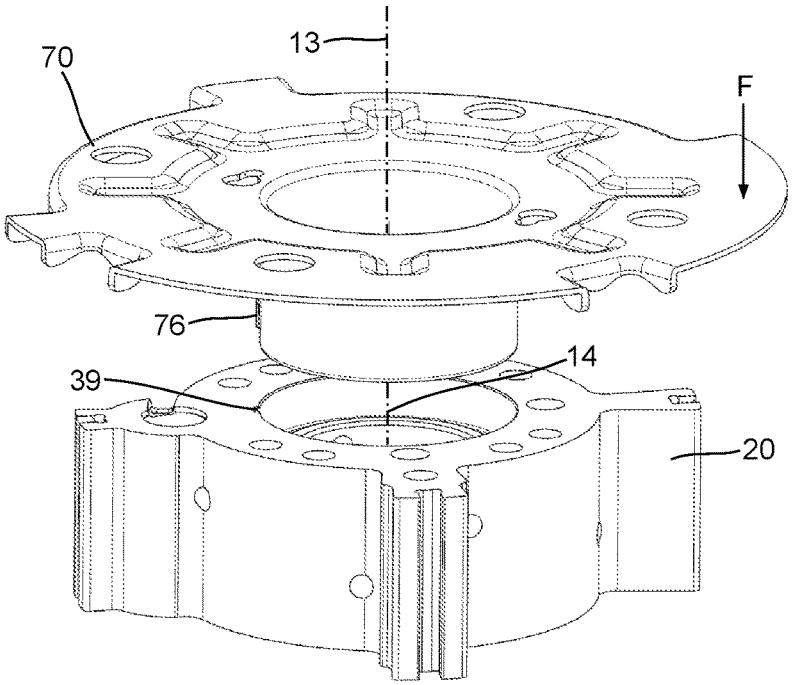
FIG. 9 is a perspective view of the timing wheel of FIG. 5A aligned for assembly with the rotor of FIG. 4A.
Figure 10A:
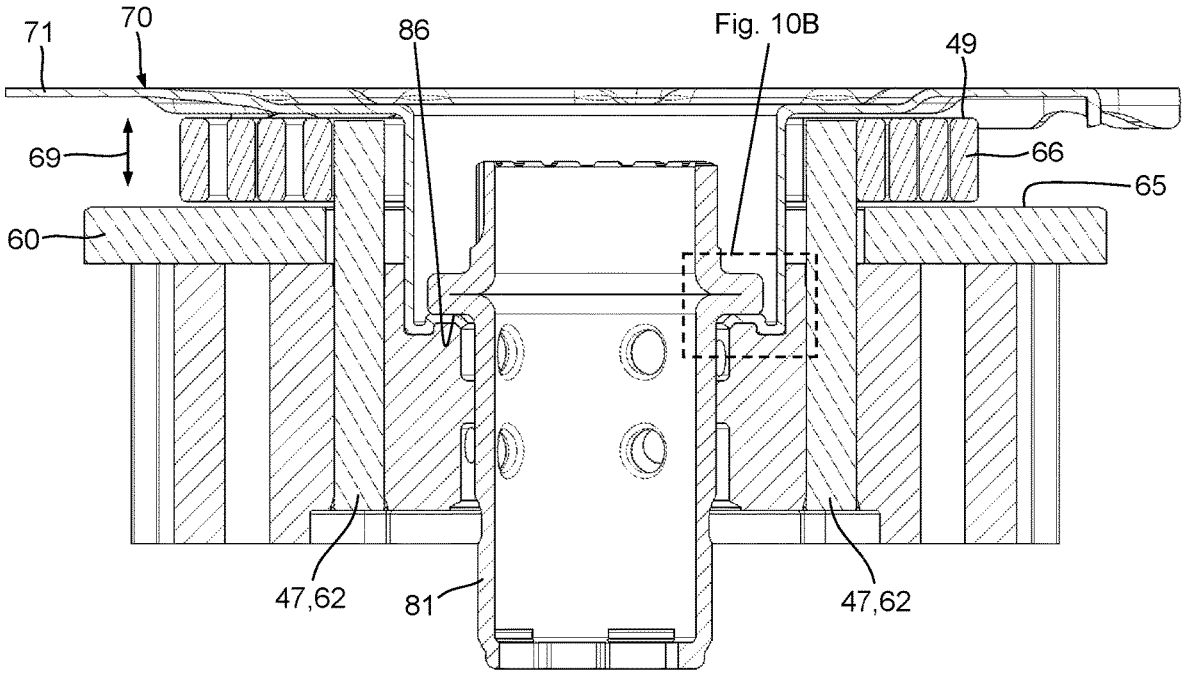
FIG. 10A is a cross-sectional view taken from FIG. 1.
Figure 10B:
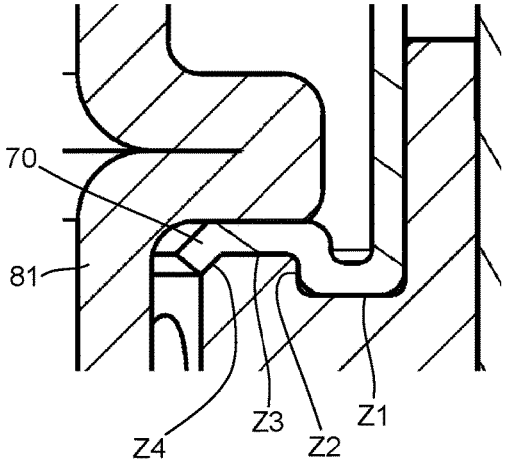
FIG. 10B is a detailed view taken from FIG. 10A.

FIG. 1 shows a perspective view of a camshaft 12 that is non-rotatably connected to a camshaft phaser 10 that includes an example embodiment of a timing wheel 70. FIG. 2 shows an exploded perspective view of the camshaft phaser 10 of FIG. 1. FIG. 3 shows a perspective view of a rotor 20 assembled with a stator 40 for the camshaft phaser 10 of FIG. 1. FIG. 4A shows a perspective view of the rotor 20; and, FIG. 4B shows a detailed view taken from FIG. 4A. FIGS. 5A and 6A show a perspective view of the timing wheel 70; and, FIGS. 5B and 6B show detail views taken from FIGS. 5A and 6A, respectively. FIG. 7A shows a perspective view of a cross-section of the timing wheel 70, and FIGS. 7B through 7D show detailed views taken from FIG. 7A. FIG. 8A shows a perspective view of a cross-section of the rotor 20, and FIG. 8B shows a detailed view taken from FIG. 8A. FIG. 9 shows a perspective view of the timing wheel 70 in a proper pre-defined orientation relative to the rotor 20. FIG. 10A shows a cross-sectional view of the camshaft phaser 10, and FIG. 10B shows a detailed view taken from FIG. 10A. The following discussion should be read in light of FIGS. 1 through 10B.

The camshaft phaser 10 includes a rotational axis 11, a first cover 50, the rotor 20, a stator 40, a bias spring 66, a second cover 60, and the timing wheel 70. A locking assembly 90 can lock and unlock the rotor 20 from the second cover 60. The stator 40 of the camshaft phaser 10 is configured with an endless drive band interface 44, to rotationally connect the camshaft phaser 10 to a power source (not shown), potentially to that of a crankshaft of an internal combustion (IC) engine. An endless drive band such as a belt or chain (not shown) can be utilized to facilitate this connection, causing the camshaft phaser 10 to rotate around the rotational axis 11.

The rotor 20 includes vanes 22 that extend radially outward from a hub portion 23 of the rotor 20. The stator 40 includes protrusions 42 that extend radially inward from an outer ring portion 46 of the stator 40. A plurality of fasteners 52 extend through first apertures 58 of the first cover 50, through clearance apertures 48 of the stator 40, and attach to second apertures 64 of the second cover 60. The first cover 50 and second cover 60, together with the vanes 22 of the rotor 20 and protrusions 42 of the stator 40, form fluid chambers 38 within the camshaft phaser 10. The fluid chambers 38 could also be described as hydraulic actuation chambers. The camshaft phaser 10 is hydraulically actuated by pressurized hydraulic fluid F that is managed by a hydraulic fluid control valve 80 to move the rotor 20 either clockwise CW or counterclockwise CCW relative to the stator 40 via the fluid chambers 38. As the rotor 20 is connected to the camshaft 12, clockwise CW and counterclockwise CCW relative movements of the rotor 20 relative to the stator 40 can advance or retard an engine valve event with respect to a four-stroke cycle of an IC engine. With reference to FIG. 3, clockwise CW rotation of the rotor 20 relative to the stator 40 can be achieved by: 1). pressurization of a first chamber 55 via a first hydraulic fluid port 54; and, 2). de-pressurization of a second chamber 57 via a second hydraulic fluid port 56. Likewise, counterclockwise CCW rotation of the rotor 20 relative to the stator 40 can be achieved by: 1). pressurization of the second chamber 57 via the second hydraulic fluid port 56; and, 2). de-pressurization of the first chamber 55 via the first hydraulic fluid port 54. The preceding pressurization and de-pressurization actions of the first and second hydraulic fluid ports 54, 56 can be accomplished by the hydraulic fluid control valve 80. The hydraulic fluid control valve 80 is fluidly connected to a hydraulic fluid pressure source 15, such as a hydraulic fluid pump, and is moved to different flow positions by an electromagnet 87; the electromagnet 87 is configured to communicate electronically with an electronic controller 88 to control the hydraulic fluid control valve 80, and, thus, the camshaft phaser 10.

The locking assembly 90 includes a locking pin 94, a force generator 96, and a retainer 98. The force generator 96 can be any component that provides a force on the locking pin 94 while permitting longitudinal movement of the locking pin 94. The force generator 96 can be a bias spring, elastomer, or any component that meets these described functional attributes. In an example embodiment, the locking assembly 90 can serve to selectively lock or unlock the rotor 20 from the stator 40, via the second cover 60 that is non-rotatably attached to the stator 40.

One purpose of the timing wheel 70 is to provide an angular position of the camshaft 12. This is accomplished by: A). non-rotatably connecting the timing wheel 70 to the rotor 20; and, B). non-rotatably connecting the rotor 20 to the camshaft 12. The timing wheel 70 includes a disk portion 71 and a cylindrical portion 72. Sensing windows 73 are formed on a radial outer wall 74 of the disk portion 71. The sensing windows 73 cooperate with a camshaft position sensor 68 to provide an angular position of the camshaft 12. The sensor 68 can electronically communicate the angular position of the camshaft 12 to the electronic controller 88.

The timing wheel 70, or the cylindrical portion 72 thereof, extends through a bore 41 of the second cover 60 and is directly attached to the rotor 20 via a radial flange 30 that extends radially inward from the cylindrical portion 72. The radial flange 30 abuts or engages with an axial fastening interface 27 of a counterbore 25 of the rotor 20. The radial flange 30 is configured with a seating surface 36S for engagement with the hydraulic fluid control valve 80, that fulfills a role of a central fastener. The hydraulic fluid control valve 80 attaches to the camshaft 12 via threads 82, causing a clamping surface 86 of a flange 84 of the hydraulic fluid control valve 80 to engage the seating surface 36S and axially clamp the radial flange 30 to the axial fastening interface 27, achieving a non-rotatable connection.

The interface between the radial flange 30 of the timing wheel 70 and the axial fastening interface 27 will now be described. The flange 30 is formed with an annular protrusion 31 that includes a base portion 32 and a leg portion 33. The annular protrusion 31, as shown in the figures, extends continuously for 360 degrees around the radial flange 30, however, it could also extend discontinuously, and/or extend less than 360 degrees. Furthermore, the shape of the annular protrusion can be any shape that is suitable to be received by the axial fastening interface 27. A flat portion 34, which includes the previously described seating surface 36S, is located radially inward of the annular protrusion 31, and formed integrally with the leg portion 33. An angled portion 35 is located radially inward of and formed integrally with the flat portion 34. The term "formed integrally" means formed into a single piece. Therefore, since the annular protrusion 31 is formed integrally with the flat portion 34, and the flat portion 34 is formed integrally with the angled portion 35, the radial flange 30 and its three components are formed from a single piece. Furthermore, the disk portion 71, the cylindrical portion 72, and the radial flange 30 are also formed integrally with one another, or from one piece, potentially via a stamping process that could be utilized to produce the timing wheel 70. The timing wheel 70 could also encompass multiple components that are attached to each other in other suitable ways to form the timing wheel 70 and the previously described features.

A length of the annular protrusion L1 (see FIG. 7B), can be greater than or less than a width W5 of the annular groove 28, forming either a press-fit or clearance fit, respectively. The annular groove 28, as shown in the figures, extends continuously for 360 degrees around the axial fastening interface 27, however, the annular groove could also be discontinuous, and/or extend less than 360 degrees. Furthermore, the shape of the annular groove can be any suitable shape to receive the annular protrusion 31 of the radial flange 30.

Each of the constituents or parts of the radial flange 30 can engage respective receiving surfaces that are arranged on the axial fastening interface 27 of the rotor 20. As shown in FIGS. 7D, 8B, and 10B, a first surface 32S of the annular protrusion 31 can engage with a bottom surface 29S of an annular groove 28 upon fastening of the timing wheel 70 to the rotor 20, forming a first contact zone Z1. Likewise, assuming a press-fit between the annular protrusion 31 and annular groove 28, a second surface 33S of the leg 33 of the annular protrusion 31 can engage with a sidewall surface 16S of the annular groove 28 to form a second contact zone Z2; a third surface 34S of the flat portion 34 can engage with a flat reception surface 17S to form a third contact zone Z3; and, a fourth surface 35S of the angled portion 35 can engage with a chamfer surface 18S to form a fourth contact zone Z4. It could be stated that: i). the first contact zone Z1 is parallel to the third contact zone Z3, ii). the second contact zone Z3 is perpendicular or transverse to the first contact zone Z1 and the third contact zone Z3, and iii). the fourth contact zone Z4 is neither parallel or perpendicular to the first, second and third contact zones Z1-Z3.

The previously described engagements or contact zones Z1-Z4 between the axial fastening interface 27 and the radial flange 30 could be described as "non-planar", or, each of the four contact zones Z1-Z4 lies in a different plane. Since, in addition to a flat plane, the term "plane" can also imply a circular plane, such as that formed by a circle or cylinder (or contact therewith), it should be stated that none of the four contact zones lie in the same circular plane; thus, in summary, for the context of this disclosure, "non-planar" signifies that the four contact zones Z1-Z4 do not lie in the same flat or circular plane.

Given that the radial flange 30 is axially clamped to the axial fastening interface 27 of the rotor 20, the previously described form of the radial flange 30 and the respective receiving surfaces of the axial fastening interface 27 can improve torsional and radial retention characteristics of the timing wheel 70 and rotor 20 assembly. It can be observed from FIG. 7B that a sum of the respective lengths of each of the segments (L1+L2+L3+L4) is greater than a width W1 of the radial flange 30, which provides for an increase in contact area that results in greater frictional resistance to relative rotational movement between the timing wheel 70 and the rotor 20. The fitment of the annular protrusion 31 within the annular groove 28 together with engagement of the angled portion 35 with the chamfer surface 18S can minimize radial movement between the timing wheel 70 and rotor 20.

The cylindrical portion 72 of the timing wheel 70 can be formed with a radial protrusion 76 that is received by a recess 39 configured within a counterbore 25 of the rotor 20. The timing wheel 70 is typically installed at a pre-defined rotational position relative to the rotor 20, and this arrangement can serve as an assembly aid to achieve the proper assembled position. The radial protrusion 76 is shaped as a quadrilateral having a width W3, however, any shape is possible. The recess 39 can be complementary in shape to the radial protrusion 76 and has a width W4 that can either be less than or greater than the width W3 of the radial protrusion 76, yielding a press-fit or clearance fit, respectively. The recess 39 extends from a radial surface 26 of the counterbore 25 and has an open end 43 to axially receive the radial protrusion 76. Furthermore, a depth D1 of the radial protrusion 76 could be less than or greater than a depth D2 of the recess 39, to yield either a radial clearance fit or press-fit, respectively. In the radial press-fit state, an outer surface 77 of the radial protrusion 76 could come into contact with an inner surface 78 of the recess. An additional protrusion and recess arranged in the timing wheel 70 and rotor 20, respectively may also be possible. Furthermore, any suitable feature(s) that align the timing wheel 70 in a pre-defined angular orientation relative to the rotor 20 could also be used.

FIG. 10A shows the assembly of the timing wheel 70 to the rotor 20 via the housing 81 of the hydraulic fluid control valve 80. The cylindrical portion 72 of the timing wheel 70 houses or surrounds a top portion of the housing 81 of the hydraulic fluid control valve 80 in its installed position. In addition, the timing wheel 70 houses the bias spring 66, providing an axial space 69 between the disk portion 71 and a face 65 of the second cover 60. The axial space 69 also houses an end of at least one elongated anchor 47 for either guiding the bias spring 66 or attaching a first end 63A and a second end 63B of the bias spring 66 to the stator 40 and rotor 20, respectively. The elongated anchors 47 for the bias spring 66 can be fulfilled by: A). dowels 62 that are attached to the rotor 20 via bores 61; and/or, B). end extensions 53 of the fasteners 52 that protrude out of the second cover 60. The cylindrical portion 72 and the disk portion 71 of the timing wheel 70 house or surround at least a portion of the bias spring 66 on a radially inner side 59 and an axially outer side 49, respectively.

Figure 11:
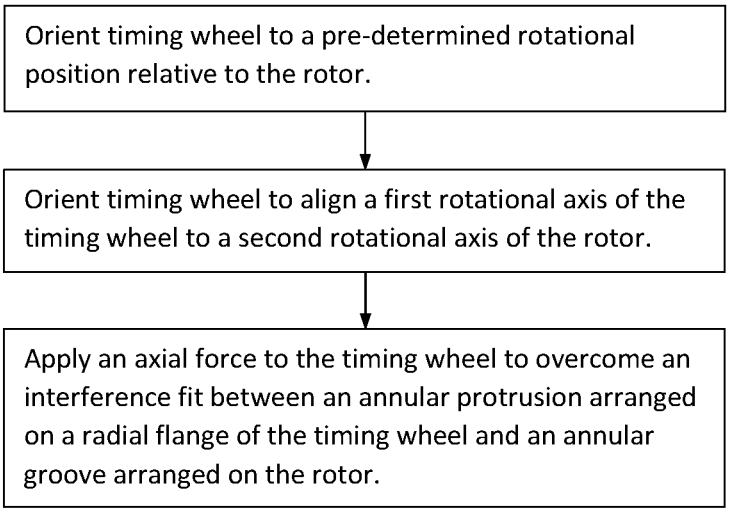
FIG. 11 is a block diagram for a method of installing the timing wheel to the rotor, both of FIG. 9.

For the previously described timing wheel 70 and rotor 20, the following installation steps can be carried out, as shown in FIGS. 9 and 11:

Orient the timing wheel 70 to a pre-defined rotational position relative to the rotor 20; the term "pre-defined" is meant to signify that the timing wheel 70 is installed at a certain rotational position (or within a tolerance range thereof) relative to the rotor 20 to ensure that a correct rotational position of the camshaft 12 is read by the camshaft position sensor 68. If the timing wheel 70 is installed at a random or incorrect rotational position relative to the rotor 20, the position of the camshaft 12 provided by the timing wheel 70 and camshaft position sensor 68 would be incorrect. Therefore, a "pre-defined" orientation of the timing wheel 70 relative to the rotor 20 signifies the opposite of a "random" orientation.

Orient the timing wheel 70 to align a first rotational axis 13 of the timing wheel 70 to a second rotational axis 14 of the rotor 20;

Assuming a press-fit between the annular protrusion 31 and annular groove 28 is the design intent, apply an axial force F to the timing wheel 70 to overcome an interference fit between the annular protrusion 31 and the annular groove 28, to seat the radial flange 30 against the axial fastening interface 27 of the rotor 20.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser comprising:

a rotational axis;

a stator;

a rotor having a plurality of vanes that form fluid chambers with the stator, the rotor configured to be non-rotatably connected to a camshaft of an internal combustion engine; and a timing wheel having:

a disk portion configured to cooperate with a camshaft position sensor to provide an angular position of the camshaft; and, a radial flange configured to be non-rotatably attached to the rotor in a pre-defined orientation; and, the rotor having an axial fastening interface that defines an annular groove configured for receiving an axially extending annular protrusion formed on the radial flange, the annular groove extending 360 degrees.

2. The camshaft phaser of claim 1, wherein the axial fastening interface further comprises a flat reception surface arranged radially inwardly of the annular groove and axially offset from a bottom surface of the annular groove, and a flat portion of the radial flange configured to be axially clamped against the flat reception surface.

3. The camshaft phaser of claim 2, wherein the radial flange further comprises an axially extending leg portion, and the annular protrusion is integrally formed with the flat portion via the leg portion.

4. The camshaft phaser of claim 3, wherein the radial flange further comprises an angled portion arranged radially inwardly of the flat portion.

5. The camshaft phaser of claim 1, wherein the annular protrusion of the timing wheel forms a press-fit with the annular groove of the rotor.

6. The camshaft phaser of claim 1, further comprising a radial protrusion arranged on the timing wheel, the radial protrusion configured to cooperate with a recess arranged on the rotor to define the pre-defined orientation of the timing wheel.

7. The camshaft phaser of claim 6, wherein the radial protrusion forms an interference fit with the recess.

8. The camshaft phaser of claim 1, wherein the disk portion includes a radial outer wall that defines sensing windows configured to cooperate with the camshaft position sensor to provide the angular position of the camshaft.

9. The camshaft phaser of claim 1, wherein the timing wheel is configured to house at least a portion of a hydraulic fluid control valve.

10. The camshaft phaser of claim 1, wherein the axially extending annular protrusion extends 360 degrees.

11. The camshaft phaser of claim 1, wherein the timing wheel is configured to house at least a portion of a bias spring.

12. The camshaft phaser of claim 11, wherein the timing wheel is configured to house the at least a portion of the bias spring on a radially inner side and an axially outer side of the bias spring.

13. The camshaft phaser of claim 1, further comprising:

a bias spring attached to the rotor and the stator; and, a cover that is non-rotatably attached to the stator; and, an axial space formed between the timing wheel and cover houses the bias spring.

14. The camshaft phaser of claim 1, further comprising a hydraulic fluid control valve configured to attach the timing wheel to the rotor.

15. The camshaft phaser of claim 1, wherein the axial fastening interface includes a chamfer that receives an angled portion of the radial flange.

16. The camshaft phaser of claim 1, wherein the axial fastening interface and the radial flange define at least four non-planar contact zones.

17. The camshaft phaser of claim 16, wherein the four non-planar contact zones extend 360 degrees.

* * * * *